US006393947B1

(12) United States Patent
Corcoran et al.

(10) Patent No.: US 6,393,947 B1
(45) **Date of Patent: *May 28, 2002**

(54) METHOD AND APPARATUS FOR LOOSENING A CLOSURE FROM A CONTAINER

(76) Inventors: Thomas P. Corcoran, 12 North Run; Gregory J. Musso, 504 Harbor Rd.; Nicholas W. Fiore, 121 Laurel La.; Kunal K. Chawla, 39 Elizabeth Dr., all of Bayer Corporation, 100 Bayer Rd., Pittsburgh, PA (US) 15205

( * ) Notice: Subject to any disclaimer, the term of this patent is extended or adjusted under 35 U.S.C. 154(b) by 0 days.

This patent is subject to a terminal disclaimer.

(21) Appl. No.: 09/583,829

(22) Filed: May 31, 2000

Related U.S. Application Data

(63) Continuation-in-part of application No. 09/583,796, filed on May 31, 2000.
(60) Provisional application No. 60/136,832, filed on Jun. 1, 1999.

(51) Int. Cl.[7] ..... B67B 7/46

(52) U.S. Cl. ..... 81/3.31; 81/3.32; 81/3.39
(58) Field of Search ..... 81/3.32, 3.31, 81/3.25, 3.39, 3.4; 157/1.26

(56) References Cited

U.S. PATENT DOCUMENTS

| | | | | |
|---|---|---|---|---|
| 2,523,448 A | * | 9/1950 | Reitz | 157/1.26 |
| 3,795,158 A | * | 3/1974 | Morita | 81/3.32 |
| 4,102,226 A | * | 7/1978 | McGuire | 81/3.32 X |
| 4,171,650 A | * | 10/1979 | Cardinal | 81/3.32 X |
| 4,919,014 A | * | 4/1990 | Chen et al. | 81/3.32 X |
| 5,329,831 A | | 7/1994 | Pierce, Jr. et al. | |
| 5,370,019 A | * | 12/1994 | Sartell et al. | 81/3.32 |
| 5,704,258 A | | 1/1998 | LaVoie | |

* cited by examiner

*Primary Examiner*—James G. Smith
(74) *Attorney, Agent, or Firm*—Joseph C. Gil; Carolyn M. Sloane

(57) ABSTRACT

Closed containers with safety caps having a push and twist opening system are loosened by compressing the container between the cap gripping means and the base of the apparatus described more fully herein, and rotating the base in a clockwise direction.

11 Claims, 5 Drawing Sheets

METHOD AND APPARATUS FOR LOOSENING A CLOSURE FROM A CONTAINER

This is a continuation-in-part of copending application Ser. No. 09/583,796, filed May 31, 2000, filed simultaneously herewith under attorney docket number NSF, which is based upon a provisional application of Ser. No. 60/136,832 filed on Jun. 1, 1999. The disclosures of the aforementioned applications are hereby incorporated herein by reference in their entirety.

BACKGROUND OF THE INVENTION

1. Technical Field

The invention relates to an apparatus for loosening a closure from a container and to the method of loosening a closure from a container. More particularly, the invention relates to an apparatus for loosening a closure from a medicine bottle and to the method of loosening a closure from a medicine bottle. Even more particularly, the invention relates to an apparatus for loosening a child resistant closure from a medicine bottle, and to the method of loosening a child resistant closure from a medicine bottle.

2. General Background

Today, people are living longer than ever. In 1940, the life expectancy was estimated at 62.9 years. Currently, the estimated life expectancy is 75.7 years. One reason that people are living longer is the availability of medications for the control or prevention of certain diseases or ailments. Most medications, as well as harmful materials such as cleaning fluids, are contained in packaging having childresistant closures. Such closures, while extremely successful in preventing the accidental opening by a child are, unfortunately, often difficult to open by a person suffering from arthritis. Individuals having limited dexterity in their hands and fingers also experience difficulty when attempting to open these closures.

3. Background Art

Devices for assisting the arthritic or disabled with the removal of child resistant closures on bottles such as prescription bottles are well known. U.S. Pat. No. 5,704,258 discloses a bottle opening device comprising a flat base member which is adapted to be secured to a counter top or the like by suction cups, a support member secured to an upper surface of the base member having a horizontally disposed slot extending there through and an elongated strap secured at one end of the support. The strap is adapted to extend about the periphery of a bottle and pass through the slot. Upon rotation of the lid and bottle in an opening direction, the strap will immobilize the bottle so that upon continued application of turning force to the lid, the lid will be unscrewed from the bottle. One drawback of the bottle opening device of the '258 patent is that a turning force must be applied to the lid in order to unscrew the lid from the bottle. A person with arthritis or with limited use of her hands or fingers would not be able to apply such a turning force.

U.S. Pat. No. 5,329,831 discloses a device for holding a container while applying torque specifically to the closure in the direction of the opening. The device as disclosed in the '831 patent comprises a containment portion having a container around which is looped a containment friction strap. The containment friction strap is looped tightly around the container. This tight loop is obtained either by hand or by the force of friction caused when the containment friction strap is in contact with the container. A motor drive causes a locked head assembly to rotate the container until the container and the friction strap loop become wedged into the front walls of the containment portion. Once the container is so wedged, the container is therefore prevented from rotating further. Torque applied to the closure results in its removal from the container. There are several drawbacks to the opener disclosed in the '831 patent.

The first drawback is that the containment portion does not contain a substantially slip resistant pad. Slippage of the container is prevented by wedging the container into the front walls of the containment portion. Another drawback in the opener disclosed in the '831 patent is that the container is opened by applying torque to the lid of the container. Applying such a torque can be difficult to achieve for a person suffering from arthritis or otherwise having limited use of her hands or fingers. Yet another drawback in the opener disclosed in the '831 patent is in the containment friction strap. Containers which are very large would require a very large containment friction strap to loop around the circumference of a container. Such a large containment friction strap would not be operational. Another drawback of the opener disclosed in the '831 patent is found in the preferred embodiment of the '831 patent. This embodiment comprises an electric drive head motor. Such an embodiment is not only costly, but also is not user friendly. A person suffering from arthritis or otherwise having limited use of her fingers or hands would have difficulty plugging the '831 patent into an appropriate electrical source. Yet another drawback of the opener disclosed in the '831 patent is found in an alternative embodiment. In the alternative embodiment, a manual handle or torque wrench is used to apply torque to the torque head. As with the preferred embodiment, manipulation of the manual handle or torque wrench is difficult for a person suffering from arthritis or otherwise having limited use of her hands.

The present invention overcomes the foregoing problems by providing an improved method and apparatus for loosening a closure from a container, in particular by providing an improved method and apparatus for loosening a closure from a medicine bottle and more particularly by providing an improved method and apparatus for loosening a child resistant closure from a medicine bottle.

SUMMARY OF THE INVENTION

In accordance with a first aspect of the present invention, an apparatus is provided for opening a closed container composed of a vessel and a safety cap with a push and twist opening system. The apparatus comprises a foundation, an adjusting platform mounted to the foundation, a rotating base with a handle which is mounted on a platform in a manner such that the base may be rotated horizontally, a vertical post which is permanently mounted to foundation, an arm to support a cap gripping means, a pin connector for attaching the vertical post to the arm, a leveling hinge which connects the cap gripping means to the arm, a cap gripping means supported by the arm and a screw mechanism positioned within the foundation for raising and the lowering adjusting platform.

In accordance with another aspect of the present invention, an apparatus for loosening safety closures from containers is provided. The apparatus comprises a foundation, a base for receiving a container rotatably attached to the foundation, the base defining a handle and comprising a surface with a substantial portion of the surface covered with a substantially slip resistant pad, a vertical post, an arm being pivotally connected to the vertical post and a cap gripping means having a surface with a substantial portion of the surface covered with a substantially slip resistant pad.

In still another aspect of the present invention, a method for opening a closed container composed of a vessel and a safety cap is provided. The closed container is positioned on the base in a manner such that the vessel of the container is placed in contact with the base and the safety cap is in contact with the cap gripping means. Sufficient pressure is applied to the cap gripping means to maintain contact between the base and the vessel of the container to be opened during the opening process. The handle of the base is held such that the base is turned in a clockwise direction. The contact of the cap gripping means is disconnected from the safety cap. The safety cap is then lifted form the vessel of the container.

In still another aspect of the present invention, a method of loosening safety closures from a container is provided. A container is provided, including a container body defining a container mouth and a container lid which connects the container lid to the container mouth to close the container mouth. The container is placed on the base of the apparatus for loosening safety closures from containers. The arm is adjusted such that the cap gripping means is in direct contact with the lid of the container. The gripping portion of the arm is then grasped so as to apply sufficient pressure to the cap gripping means to maintain the direct contact between the cap gripping means and the lid of the container, while at the same time the handle of the base is held and turned in a clockwise direction.

In yet another aspect of the present invention, a method of loosening safety closures is provided. A container is provided, including a container body defining a container mouth and a container lid which connects the container lid to the container mouth to close the container mouth. The container is placed on the base of the apparatus for loosening safety closures from containers. The arm is adjusted so that it is received by the fixable height adjusting means such that the cap gripping means is in direct contact with the lid of the container. The gripping portion of the arm is then grasped so as to apply sufficient pressure to the cap gripping means to maintain the direct contact between the cap gripping means and the lid of the container, while at the same time the handle of the base is held and turned in clockwise direction.

DETAILED DESCRIPTION OF THE PRESENT INVENTION

Figure 1:
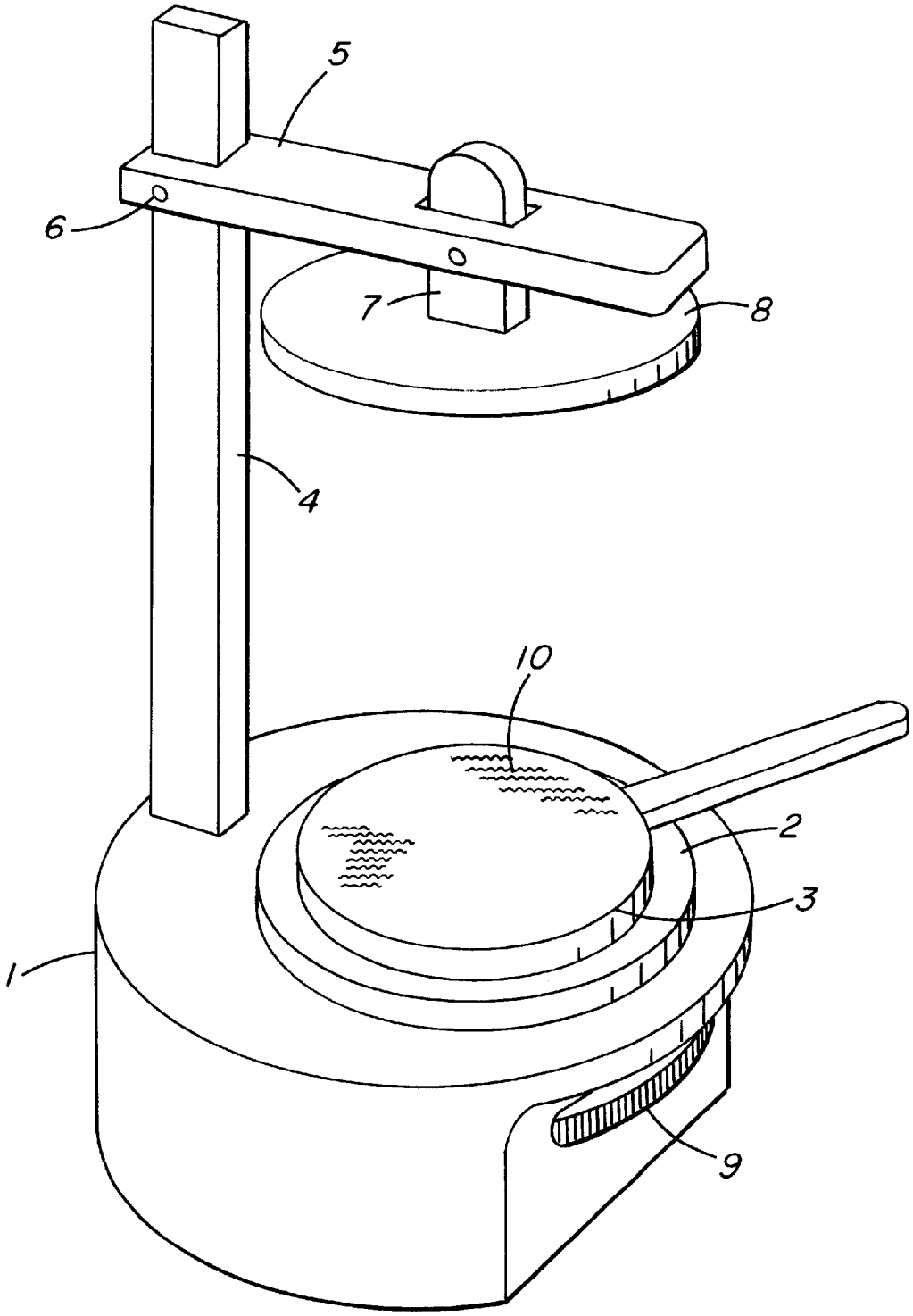
FIG. 1 illustrates the apparatus of the present invention.
Figure 2:
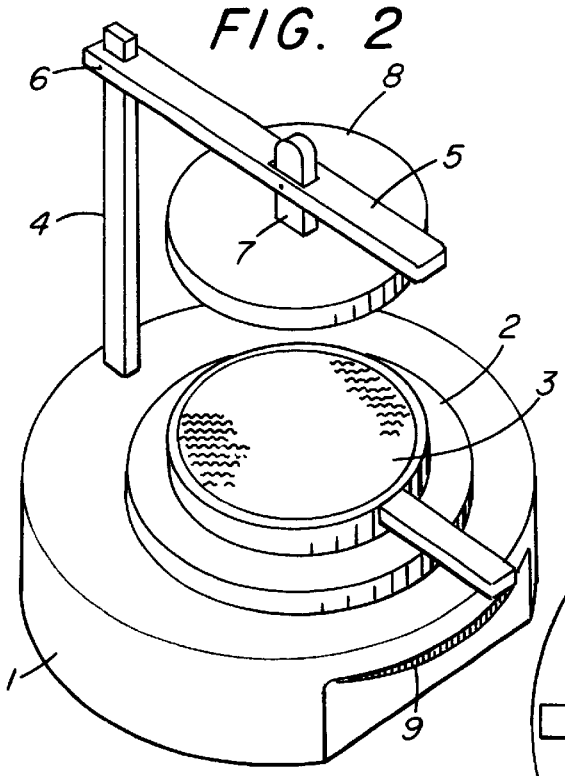
FIG. 2 is a perspective view of the apparatus of the present invention.
Figure 4:
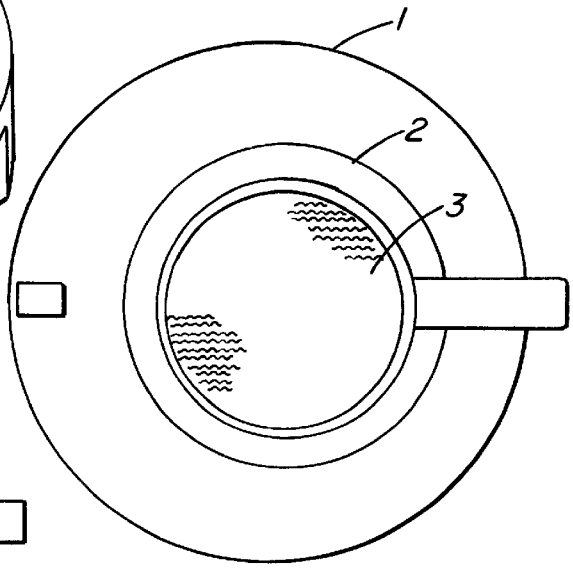
FIG. 4 is an overhead view of the apparatus of the present invention.
Figure 3:
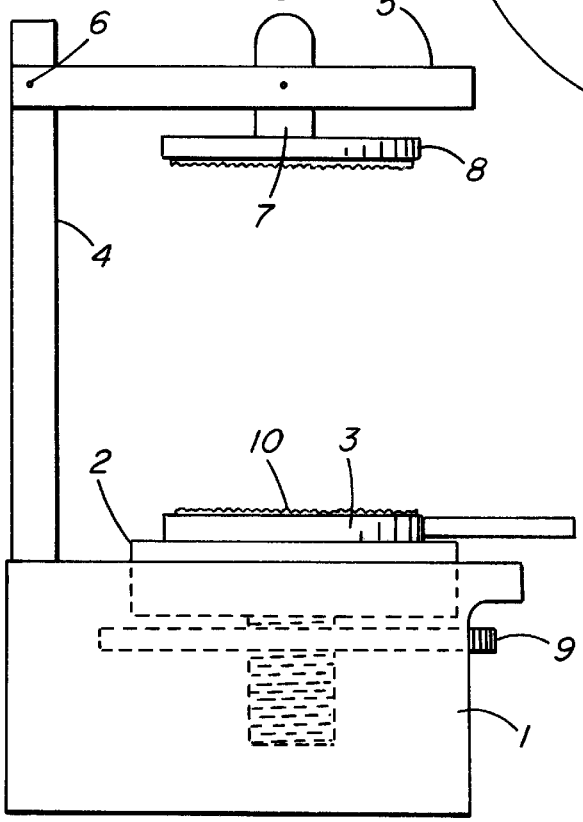
FIG. 3 is a side view of the apparatus of the present invention.

An apparatus for loosening safety closures made according to the present invention is shown in FIG. 1. An adjusting platform 2 is mounted on foundation 1. A rotating base with a handle 3 is mounted on adjusting platform 2 in a manner such that it may be horizontally rotated in a clockwise or counterclockwise motion by pushing the handle. Vertical post 4 is permanently affixed to foundation 1. Screw mechanism 9 raises and lowers adjusting platform 2. Arm 5 which supports cap gripping means 8 is attached to vertical post 4 by connector means 6. Cap gripping means 8 is connected to arm 5 by movable leveling hinge 7. The gripping surfaces of base 3 and cap gripping means 8 are covered with a material 10 that prevents the vessel and cap of a container-to-be-opened from slipping during the opening process.

Prior to use of the apparatus of the present invention, base 3 is generally positioned so that the handle will be in close proximity to vertical post 4 and the base 3 may be moved in a clockwise direction during the opening process.

In using the apparatus of the present invention, a closed container made up of a safety cap and a receiving vessel is placed upon base 3 in a manner such that the vessel portion of the container will be in contact with base 3. Adjusting platform 2 is raised by turning screw mechanism 9 to adjust the distance between base 3 and cap gripping means 8 to permit the container to be opened to be inserted. Cap gripping means 8 is then brought into contact with the. safety cap of the closed container. Sufficient pressure is applied to the closed container to maintain contact between base 3 and the vessel, contact between cap gripping means 8 and the child-resistant cap and to compress the container between cap gripping means 8 and base 3. After application of pressure has begun, the user takes hold of the handle of base 3 and horizontally rotates it about platform 2 in a clockwise direction. Contact between cap gripping means 8 and the safety cap is then discontinued. The container may then be removed from base 3 and the safety cap lifted from the vessel portion of the container.

Figure 5:
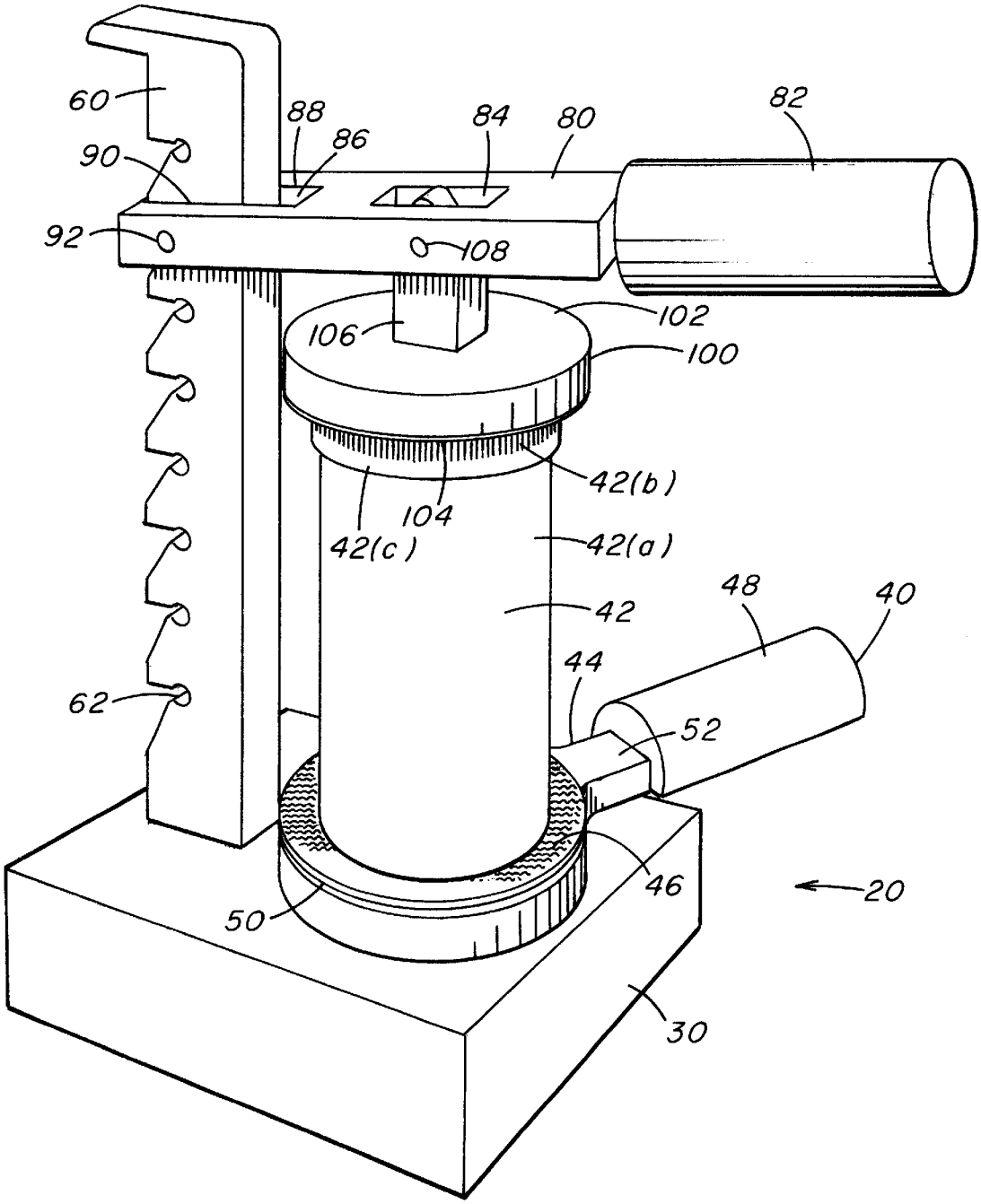
FIG. 5 is a perspective view of the apparatus of the present invention.

An apparatus for loosening safety closures 20 made according to another aspect of the present invention is depicted in FIG. 5. The apparatus 20 includes a foundation 30. Any type of substantially rigid structure may be used as the foundation 30. A preferred foundation is a foundation of wood, or of reinforced fiberglass or of other composite materials. A more preferred foundation is a foundation made of aluminum. A most preferred foundation is a foundation made of plastic. The apparatus also includes a base 40 for receiving a container 42. Any type of substantially rigid structure may be used as base 40. A preferred foundation is a base of wood or of reinforced fiberglass or of other composite materials. A more preferred foundation is a base made of aluminum. A most preferred foundation is a foundation made of plastic. Base 40 includes surface 44 with a substantial portion of surface 44 covered with substantially slip resistant pad 46. Any type of slip resistant material may be employed as the slip resistant pad. A preferred slip resistant pad 46 is a rubber pad. A more preferred slip resistant pad 46 is a textured rubber pad. Apparatus 20 further comprises vertical post 60 which may be affixed to foundation 30. Any substantially rigid structure can be used for the vertical post. A preferred structure is a vertical post made of wood or of reinforced fiberglass or of other composite materials. A more preferred structure is a vertical post made of aluminum. A most preferred structure is a vertical post made of plastic. Apparatus 20 further comprises arm 80. Any substantially rigid structure can be used for arm 80. A preferred structure is an arm made of wood or of reinforced fiberglass or of other composite materials. A more preferred structure is an arm made of aluminum. A most preferred structure is an arm made of plastic. Apparatus 20 also comprises cap gripping means 100 having surface 102 with a substantial portion of surface 102 of cap gripping means 100 covered with cap gripping means substantially slip resistant pad 104. Any substantially slip resistant pad may be employed. A preferred slip resistant pad is a rubber pad. A more preferred slip resistant pad is a textured rubber pad.

Figure 7:
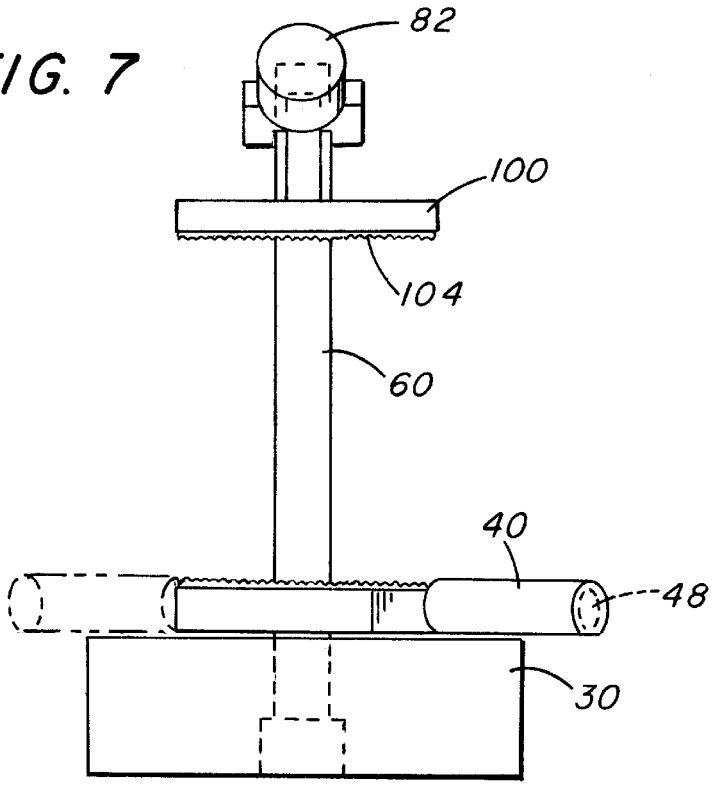
FIG. 7 is a front view of the apparatus of the present invention.
Figure 8:
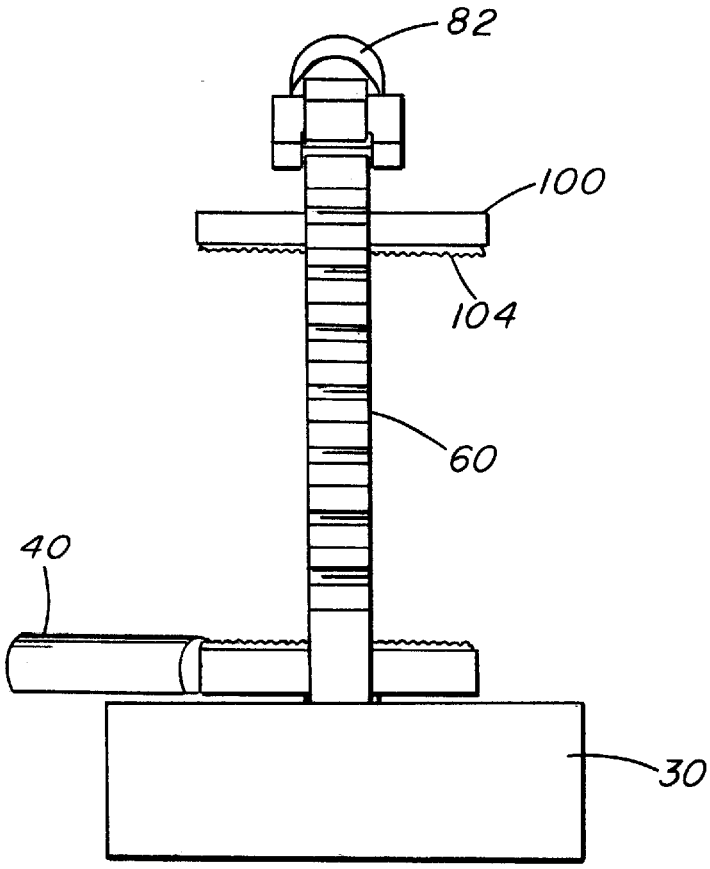
FIG. 8 is a back view of the apparatus of the present invention.
Figure 9:
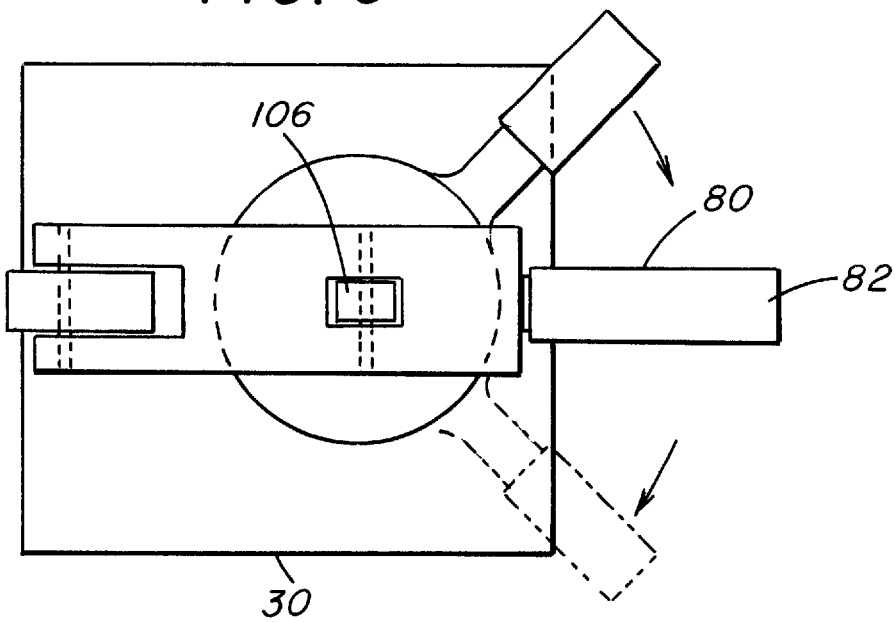
FIG. 9 is a top view of the apparatus of the present invention.

Referring still to FIG. 5, in accordance with one embodiment of this aspect of the present invention, the base 40 is rotatably attached to foundation 30. Any type of rotating means for rotatably attaching base 40 to foundation 30 can be employed. A preferred rotating means is a cylinder with a fastener mounted on foundation 30 with a frictionless means. Any of the aforementioned rotating means can be located on foundation 30 or on base 40. FIG. 7 depicts a cylinder with a fastener and a frictionless means attaching base 40 to foundation 30.

In viewing FIG. 5, base 40 further comprises base handle portion 48, container receiving portion 50, and middle portion 52 situated between base handle portion 48 and container receiving portion 50. Any type of handle material can be employed. A preferred handle is a handle of wood or of reinforced fiberglass or of other composite materials. A more preferred handle is a handle of aluminum. A most preferred handle is a handle of plastic. Additionally, the handle can be substantially surrounded by a material providing a cushion to the hand of the user. Any type of non-rigid material can be employed for substantially surrounding the handle. A preferred nonrigid material is foam. A most preferred non-rigid material is a memory foam.

Figure 6:
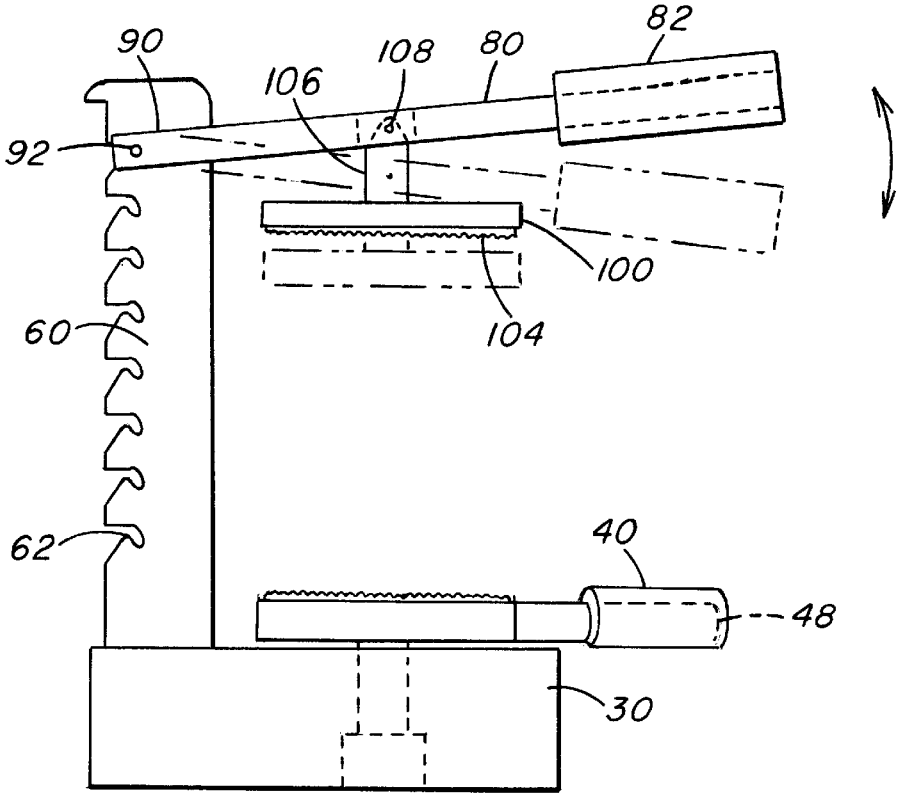
FIG. 6 is a side view of the apparatus of the present invention

Referring now to FIG. 6, vertical post 60 of apparatus 20 is placed in a permanent or removable orientation with foundation 30. In one embodiment of this aspect of the present invention, vertical post 60 is removably attached to foundation 30. In the preferred embodiment of this aspect of the present invention, vertical post 60 is affixed to foundation 30. Any means for affixing vertical post 60 on foundation 30 can be used. A preferred affixing means is a nail. A more preferred affixing means is a screw. A most preferred affixing means is an adhesive. Any means for removably placing vertical post 60 on foundation 30 can be used. A preferred removable placing means is a screw. A more preferred removable placing means is a groove or notch. A most preferred removable placing means is pin.

Referring still to FIG. 6, in accordance with another aspect of the present invention, vertical post 60 of apparatus 20 comprises at least one fixable height adjusting means, such as at least one notch 62 capable of receiving arm 80 at a certain distance from base 40. Any type of fixable height adjusting means capable of receiving arm 80 can be employed. A preferred fixable height adjusting means is a stainless steel pin connector. A most preferred retention means is at least one notch 62.

Referring back to FIG. 5, arm 80 of apparatus 20 comprises an arm handle portion 82, slotted section 84 and cut away area 86 defining first side 88 and second side 90, slotted section 84 being situated between arm handle portion 82 and the cut away area 86. Any type of handle material can be employed. A preferred handle is a handle of wood or of reinforced fiberglass or of other composite materials. A more preferred handle is a handle of aluminum. A most preferred handle is a handle of plastic. Additionally, the handle can be substantially surrounded by a material providing a cushion to the hand of the user. Any type of non-rigid material can be employed for substantially surrounding the handle. A preferred non-rigid material is foam. A most preferred non-rigid material is a memory foam.

Referring now to FIGS. 5 and 6, pin connector 92 connects first side 88 of cut away area 86 to second side 90 of cut away area 86. Any type of permanent or removable pin connector can be used in the invention. A preferred pin connector is a pin connector made of metal, plastic or aluminum. A more preferred pin connector is a pin connector made of steel. A most preferred pin connector is a pin connector made of stainless steel.

Referring still to FIGS. 5 and 6, cutaway area 86 of arm 80 is received by vertical post 60 while pin connector 92 is received by at least one notch 62 of vertical post 60. Cap gripping means 100 comprises substantially slip resistant pad 104. Leveling hinge 106 lies adjacent cap gripping means 100. Leveling hinge pin 108 connects hinge 106 to slotted section 84 of arm 80.

Any type of permanent or removable leveling hinge pin can be used in the invention. A preferred leveling hinge pin is a leveling hinge pin made of metal, plastic or aluminum. A more preferred leveling hinge pin is a leveling hinge pin made of steel. A most preferred leveling hinge pin is a leveling hinge pin made of stainless steel.

Referring now to FIG. 5, container 42 is provided, including container body 42*a* defining container mouth 42*b* and container lid 42*c*, which connects container lid 42*c* to container mouth 42*b* to close container mouth 42*b*. The container 42 is placed on base 40 of apparatus 20. Arm 80 is adjusted such that cap gripping means 100 is in direct contact with lid 42*c* of container 42. Arm handle portion 82 of arm 80 is then grasped so as to apply sufficient pressure to cap gripping means 100 to maintain direct contact between cap gripping means 100 and lid 42*c* of container 42. Simultaneously, base handle portion 48 of base 40 is held and turned in clockwise direction.

Referring again to FIG. 5, container 42 is provided, including container body 42*a* defining container mouth 42*b* and container lid 42*c* which connects container lid 42*c* to container mouth 42*b* to close container mouth 42*b*. Container 42 is placed on base 40 of apparatus 20. Arm 80 is adjusted such that pin connector 92 is received by at least one notch 62 of vertical post 60 and such that cap gripping means 100 is in direct contact with lid 42*c* of container 42. Arm handle portion 82 of arm 80 is then grasped so as to apply sufficient pressure to cap gripping means 100 to maintain the direct contact between cap gripping means 100 and lid 42*c* of container 42. Simultaneously, handle portion 48 of base 40 is held and turned in clockwise direction.

We claim:

1. An apparatus for loosening safety closures from containers comprising:

(a) a foundation;

(b) a base for receiving a container rotatably attached to the foundation having a surface defining a handle, with a substantial portion of the surface covered with a substantially slip resistant pad;

(c) a vertical post;

(d) an arm being pivotally connected to the vertical post; and (e) a cap gripping means having a surface with a substantial portion of the surface covered with a substantially slip resistant pad.

2. The apparatus of claim 1 wherein the foundation comprises a screw mechanism for receiving the base.

3. The apparatus of claim 1 wherein the vertical post comprises a fixable height adjusting means.

4. The apparatus of claim 3 wherein the fixable height adjusting means is at least one notch.

5. The apparatus of claim 1 wherein the arm defines an arm handle portion.

6. The apparatus of claim 5 wherein the arm handle portion is substantially surrounded by a material providing a cushion to the hand of the user.

7. A method of loosening safety closures from a container with an apparatus comprising (i) a foundation; (ii) a base for receiving a container rotatably attached to the foundation having a surface defining a handle, with a substantial portion of the surface covered with a substantially slip resistant pad; (iii) a vertical post, (iv) an arm being pivotally connected to the vertical post; and (v) a cap gripping means having a surface with a substantial portion of the surface covered with a substantially slip resistant pad, the container including a container body defining a container mouth and a container lid which connects the container lid to the container mouth to close the container mouth, comprising the steps of:

(a) placing the container on the base;

(b) adjusting the arm such that the cap gripping means is in direct contact with the lid of the container;

(c) grasping the arm handle portion of the arm so as to apply sufficient pressure to the cap gripping means to maintain the direct contact between the cap gripping means and the lid of the container; and (d) holding the base handle portion and turning it in a clockwise direction.

8. A method of loosening safety closures from a container with an apparatus comprising (i) a foundation; (ii) a base for receiving a container rotatably attached to the foundation having a surface defining a handle, with a substantial portion of the surface covered with a substantially slip resistant pad; (iii) a vertical post; (iv) an arm being pivotally connected to the vertical post; and (v) a cap gripping means having a surface with a substantial portion of the surface covered with a substantially slip resistant pad, the container including a container body defining a container mouth and a container lid which connects the container lid to the container mouth to close the container mouth, comprising the steps of:

(a) placing the container on the base;

(b) employing a fixable height adjusting means on the vertical post;

(c) adjusting the arm so as to be received by the height adjusting means such that the cap gripping means is in direct contact with the lid of the container;

(d) grasping the arm handle portion so as to apply sufficient pressure to the cap gripping means to maintain the direct contact between the cap gripping means and the lid of the container; and (e) holding the base handle portion and turning it in a clockwise direction.

9. A method of loosening a safety closure from a container according to claim 8, further comprising employing a pin connector.

10. A method of loosening a safety closure from a container according to claim 8, further comprising employing at least one notch as the fixable height adjusting means.

11. A method of loosening a safety closure from a container according to claim 10, further comprising the step of the adjusting the arm so that the pin connector is received by at least one notch of the vertical post.

* * * * *